US005975556A

United States Patent [19]

Lehmann

[11] Patent Number: 5,975,556

[45] Date of Patent: Nov. 2, 1999

[54] SNOWBOARD BINDING

[76] Inventor: Ernest Lehmann, 2233 Dalis Dr., Concord, Calif. 94520

[21] Appl. No.: 08/998,472

[22] Filed: Dec. 26, 1997

Related U.S. Application Data

[63] Continuation-in-part of application No. 08/878,038, Jun. 18, 1997, abandoned.

[51] Int. Cl.[6] ..... B62K 1/00

[52] U.S. Cl. ..... 280/624; 280/14.2; 280/618; 292/167

[58] Field of Search ..... 280/14.27, 624, 280/618, 617, 625; 292/166, 167, 168, DIG. 49

[56] References Cited

U.S. PATENT DOCUMENTS

| | | | |
|---|---|---|---|
| 4,230,351 | 10/1980 | Bisbing | 292/DIG. 49 |
| 4,828,299 | 5/1989 | Poe | 292/DIG. 49 |
| 4,911,485 | 3/1990 | Wasilewski | 292/DIG. 49 |
| 4,973,073 | 11/1990 | Raines et al. | 280/624 |
| 5,299,923 | 4/1994 | Glaser | 280/14.2 |
| 5,505,478 | 4/1996 | Napoliello | 280/14.2 |
| 5,520,406 | 5/1996 | Anderson et al. | 280/14.2 |
| 5,690,311 | 11/1997 | Leighton et al. | 292/DIG. 49 |
| 5,690,351 | 11/1997 | Karol | 280/14.2 |
| 5,722,680 | 3/1998 | Dodge | 280/14.2 |
| 5,762,357 | 6/1998 | Ratzek et al. | 280/14.2 |

*Primary Examiner*—Paul N. Dickson
*Assistant Examiner*—Lynda Jasmin
*Attorney, Agent, or Firm*—Jack Lo

[57] ABSTRACT

A snowboard binding includes a base plate for supporting a universal boot plate. A pair of locking slots are arranged on the sides of the universal boot plate. A fixed locking latch is attached to the base plate on one edge thereof for engaging one of the locking slots. A latch assembly is attached to the base plate on an opposite edge thereof. A slidable locking latch in the latch assembly is operable for engaging the other locking slot on the universal boot plate. The slidable locking latch is actuated by a cam member with an arcuate cam slot having a center eccentric to an axle of the cam member. The slidable locking latch is connected to the cam slot by a pin. When the cam member is rotated by a lever attached to the axle, the cam slot affects linear motion in the slidable locking latch, which is caused to extend or retract for respectively locking or releasing the universal boot plate. An alternative latch assembly includes a pivoting lever connected to a spring-loaded slidable locking latch by a connecting arm. The boot plate is attached by stepping down on the slidable locking latch, which is caused to retract and snap back into a locking position when the boot plate is fully seated. The boot plate is released by pressing down the lever to retract the slidable locking latch.

4 Claims, 5 Drawing Sheets

SNOWBOARD BINDING

CROSS REFERENCE TO RELATED APPLICATIONS

This is a continuation-in-part of application Ser. No. 08/878,038, filed Jun. 18, 1997, now abandoned.

BACKGROUND OF THE INVENTION

1. Field of the Invention

This invention relates generally to snowboard bindings.

2. Prior Art

A snowboard is a device resembling a small surfboard, and used much like a surfboard for descending a snow covered slope. A typical snowboard includes bindings for removably attaching a pair of specially adapted hard boots that resemble snow ski boots. Some snowboards, particularly the ones for rent, include universal boot plates with adjustable straps for removably fastening conventional soft boots of any size for convenience and low cost. The universal boot plates are removably attached to the snowboard by specialized bindings on the board. The universal boot plates may be detached from the bindings and snowboard, so that the user may walk with the boot plates still fastened to the soft boots. Universal boot plate bindings typically employ a latch for locking the boot plate in position. The latch is arranged for engaging and disengaging from the boot plate by a spring-loaded lever, which may be actuated by a linear or rotary motion.

Some universal boot plate bindings have an exposed latch assembly which tends to be covered in snow and ice, so that it may become difficult to operate or even jammed. Further, due to the simple spring loading, the latch may be unintentionally retracted under some circumstances when particular forces are applied to the boot plate. The user's foot may thus be released from the board, and the user may lose control.

OBJECTS OF THE INVENTION

Accordingly an object of the present invention is to provide a snowboard binding that resists accidental release.

Another object of the present invention is to provide a snowboard binding that resists jamming by snow and ice.

Further objects of the present invention will become apparent from a consideration of the drawings and ensuing description.

BRIEF SUMMARY OF THE INVENTION

A snowboard binding includes a base plate for supporting a universal boot plate. A pair of locking slots are arranged on the sides of the universal boot plate. A fixed locking latch is attached to the base plate on one edge thereof for engaging one of the locking slots. A latch assembly is attached to the base plate on an opposite edge thereof. A slidable locking latch in the latch assembly is operable for engaging the other locking slot on the universal boot plate. The slidable locking latch is actuated by a cam member with an arcuate cam slot having a center eccentric to an axle of the cam member. The slidable locking latch is connected to the cam slot by a pin. When the cam member is rotated by a lever attached to the axle, the cam slot affects linear motion in the slidable locking latch, which is caused to extend or retract for respectively locking or releasing the universal boot plate. An alternative latch assembly includes a pivoting lever connected to a spring-loaded slidable locking latch by a connecting arm. The boot plate is attached by stepping down on the slidable locking latch, which is caused to retract and snap back into a locking position when the boot plate is fully seated. The boot plate is released by pressing down the lever to retract the slidable locking latch.

DRAWING REFERENCE NUMERALS

| | |
|---|---|
| 10. Snowboard Binding | 11. Base Plate |
| 12. Base Plate Clamp | 13. Mounting Holes |
| 14. Universal Boot Plate | 15. Fixed Locking Latch |
| 16. Center of Cam Slot Arc | 17. Latch Assembly |
| 18. Lever | 19. Locking Slot |
| 20. Locking Slot | 21. Upper Housing |
| 22. Lower Housing | 23. Opening |
| 24. Slidable Locking Latch | 25. Hole |
| 26. Slot | 27. Cam Member |
| 28. Axle | 29. Cam Slot |
| 30. Pin | 31. Channel |
| 32. Guide Slots | 33. Guide Rails |
| 34. Index Dimples | 35. Ball |
| 36. Hole | 37. Spring |
| 38. Hexagonal Holes | 39. Self-Clinching Standoff Fasteners |
| 40. Screws | 41. Retaining Pin |
| 42. Latch Assembly | 43. Lower Housing |
| 44. Channel | 45. Slidable Locking Latch |
| 46. Guide Slots | 47. Guide Rails |
| 48. Hexagonal Holes | 49. Upper Housing |
| 50. Fasteners | 51. Screws |
| 52. Slot | 53. Extensions |
| 54. Holes | 55. Pin |
| 56. Push rod | 57. Brackets |
| 58. Lever | 59. Pin |
| 60. Slot | 61. Opening |
| 62. Springs | 63. Recesses |
| 64. Axles | 65. Ears |

DETAILED DESCRIPTION OF THE INVENTION

FIGS. 1–2

Figure 1:
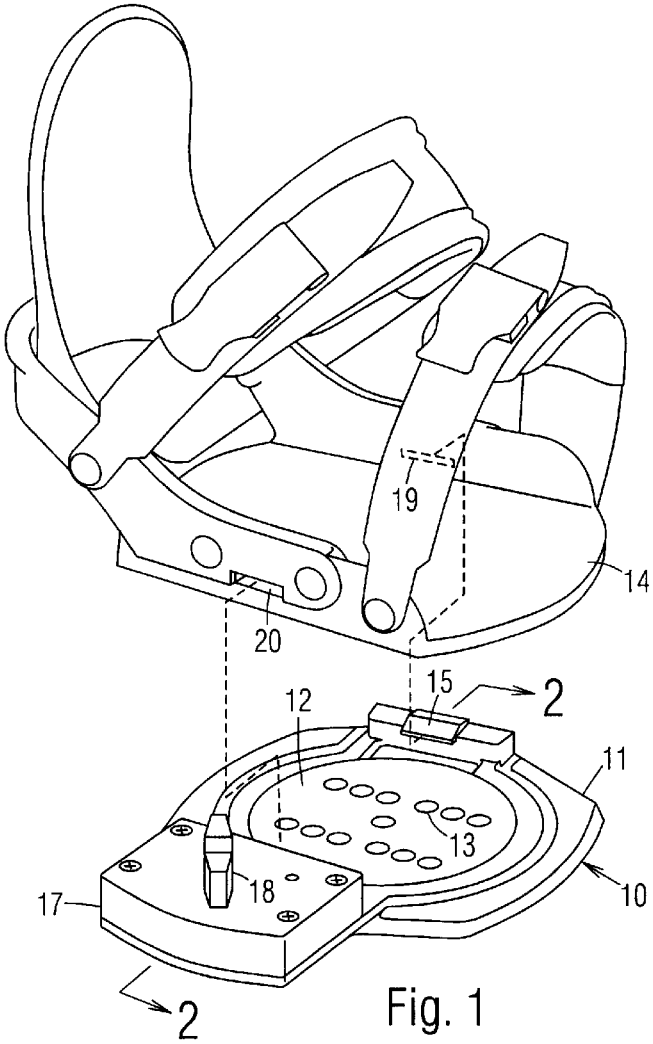
FIG. 1 is a side perspective view of a snowboard binding prior before a universal boot plate is attached thereon.

In accordance with a preferred embodiment of the invention shown in the side perspective view of FIG. 1, a snowboard binding 10 includes a base plate 11 with a circular base plate clamp 12 positioned in a central opening therein, so that base plate 11 is adjustable in azimuth in 10 degree increments. Mounting holes 13 are arranged on base plate clamp 12 for mounting to a snowboard (not shown). Base plate 11 is adapted for supporting a universal boot plate 14. A fixed locking means or locking latch 15 is positioned at one side edge of base plate 11, and spaced vertically from the surface of base plate 11. A latch assembly 17 is positioned on the opposite side edge of base plate 11 across from fixed locking latch 15. Latch assembly 17 includes a lever 18 positioned on top thereof. Lever 18 is shown in the unlocked position. A pair of complementary engaging means or locking slots 19 and 20 are arranged on opposite sides of universal boot plate 14 for respectively mating with fixed locking latch 15 and latch assembly 17.

Figure 2:
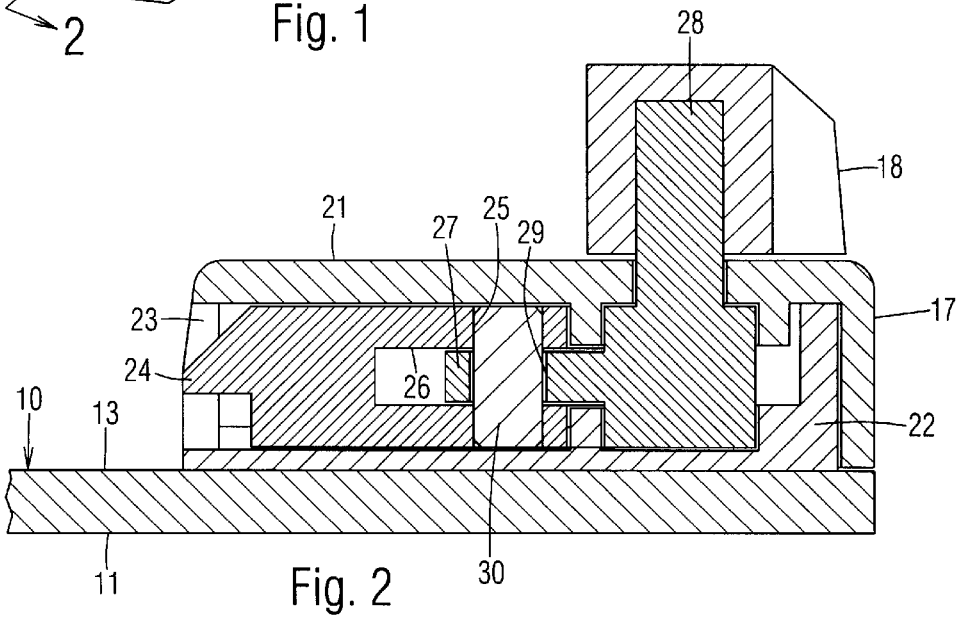
FIG. 2 is a side sectional view of the snowboard binding of FIG. 1.

As shown in the side sectional view in FIG. 2, latch assembly 17 includes an upper housing 21 and a lower housing 22. An opening 23 is arranged on the inner side of housings 21 and 22. A slidable locking means or locking latch 24, shown retracted inside opening 23, is positioned between housings 21 and 22. Slidable locking latch 24 includes a vertical through hole 25 at an inner end, and a horizontal slot 26 extending inwardly from the inner end, so that hole 25 intersects slot 26. A horizontal cam member 27 is movably positioned within slot 26 of slidable locking latch 24. Cam member 27 is arranged for rotation about a vertical axle 28 extending through upper housing 21. A cam slot 29 on cam member 27 is movably connected to slidable locking latch 24 by a pin 30 positioned through hole 25 and cam slot 29. Lever 18 is fixedly attached to the upper end of axle 28. Upper and lower housing 21 and 22 are attached to base plate 11.

FIGS. 3–4

Figure 3:
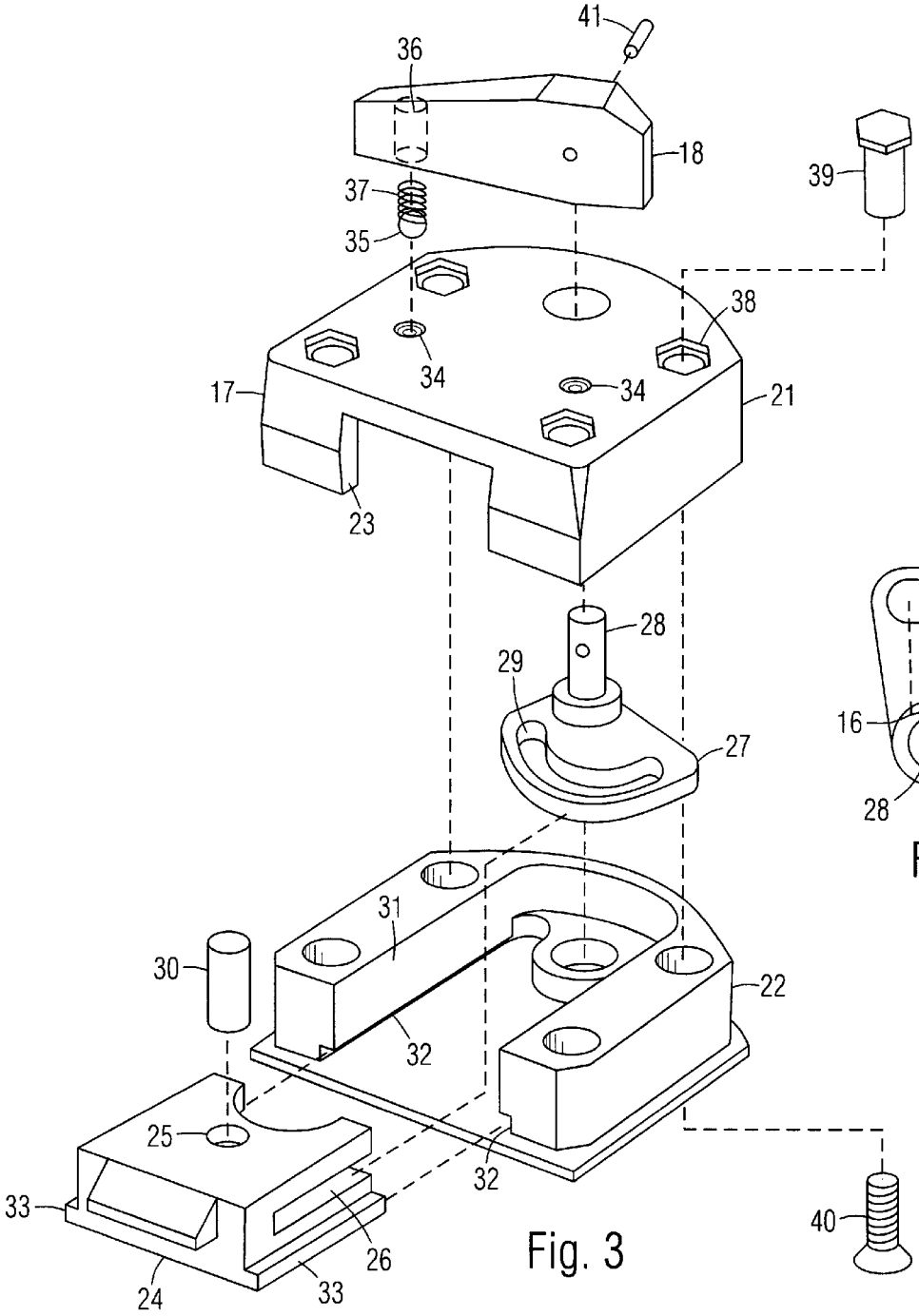
FIG. 3 is an exploded view of a latch assembly of the snowboard binding.

Latch assembly 17 is shown in an exploded view in FIG. 3 with mating parts connected by dashed lines. Lower housing 22 includes a channel 31 for receiving slidable locking latch 24. A pair of longitudinal guide slots 32 extend along the sides of channel 31 for slidably receiving a pair of longitudinal guide rails 33 extending along the sides of slidable locking latch 24. Hexagonal holes 38 on upper housing 21 receive self-clinching standoff fasteners 39 (one shown), which mate with flathead screws 40 (one shown) extending upwardly through base plate 11 (FIG. 1) and lower housing 22. A pair of index dimples 34 are arranged on top of upper housing 21 for engaging a spring-loaded ball 35 positioned in a hole 36 extending upwardly from the bottom of lever 18. A spring 37 is positioned against ball 35 for loading it downwardly against a dimple, so as to fixate lever 18 in extreme rotary positions that correspond to a locked position and an unlocked position, which are about 70 degrees apart relative to axle 28. Lever 18 is retained on axle 28 by a retaining pin 41 extending through matching holes therein.

Figure 4:
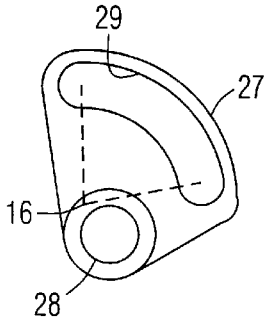
FIG. 4 is a top view of a cam member in the latch assembly of the snowboard binding.

Cam member 27 is shown in a top view in FIG. 4. Arcuate cam slot 29 has a center 16 which is eccentric to axle 28. Relative to axle 28, the radius of cam slot 29 is varied gradually from the smallest radius at one end, to the greatest radius at the opposite end. Thus when cam member 27 is rotated, slidable locking latch 24 is actuated to move linearly in or out of channel 31.

FIGS. 5–6

Figure 5:
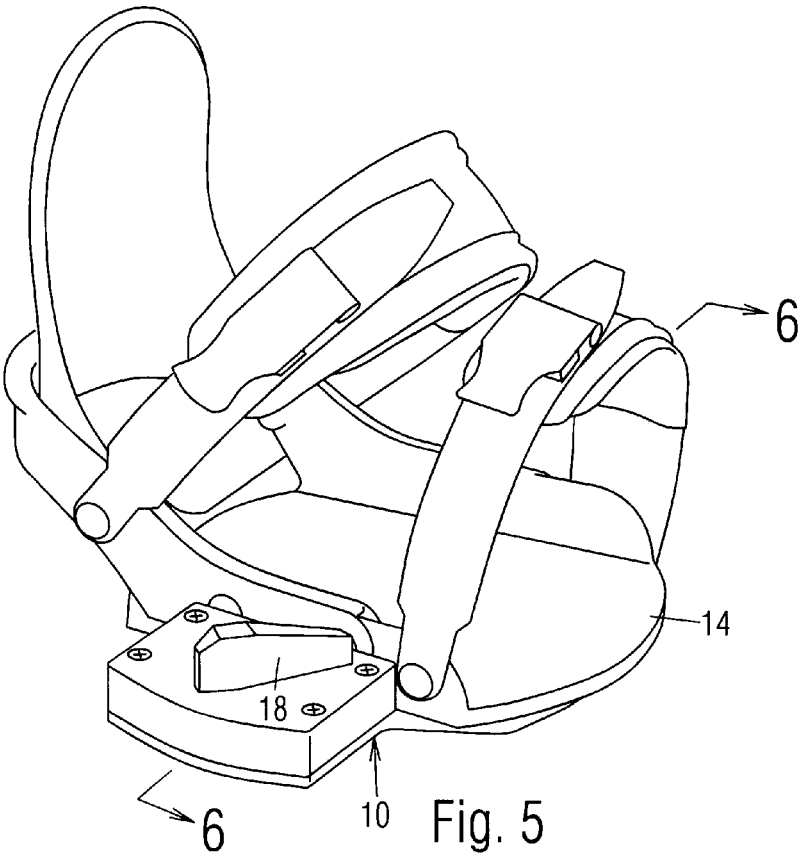
FIG. 5 is a side perspective view of the snowboard binding after the boot plate is attached thereon.
Figure 6:
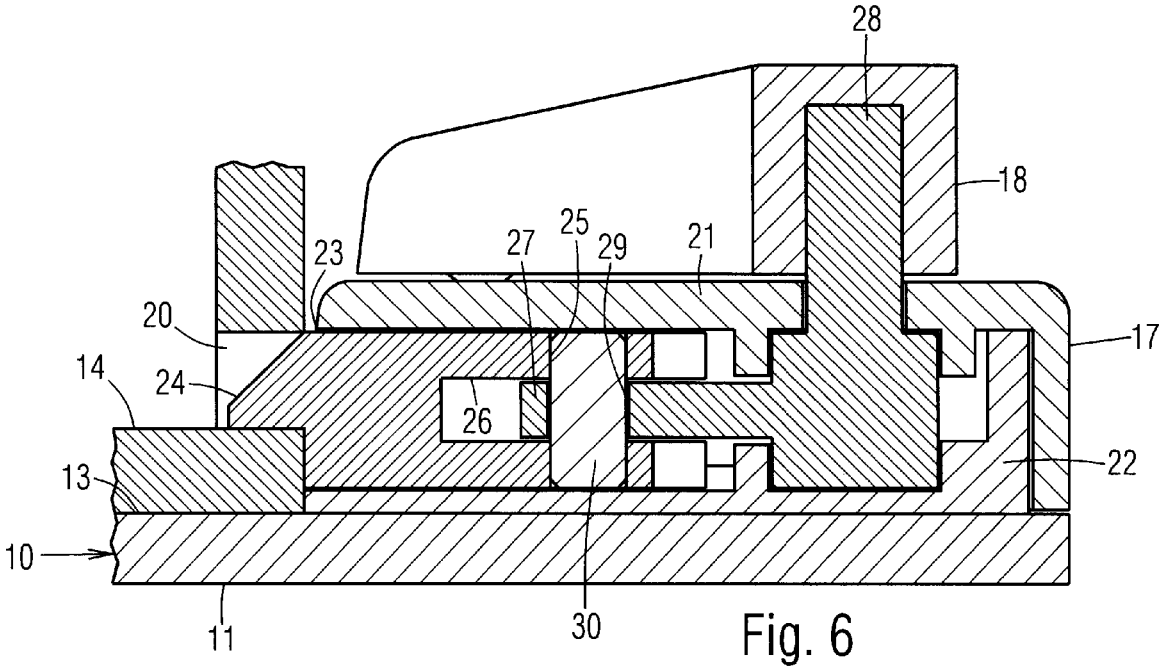
FIG. 6 is a side sectional view of the snowboard binding of FIG. 5.

Universal boot plate 14 is shown attached to snowboard binding 10 in FIG. 5. Lever 18 is moved to the locked position. As shown in the sectional view in FIG. 6, cam member 27 has been rotated about axle 28, and pin 30 is now located at the end of cam slot 29 with the greatest distance from axle 28. Cam member 27 has thus pushed slidable locking latch 24 outwardly through opening 23, so that the distal end of slidable locking latch 24 is engaged within locking slot 20 of boot plate 14. Fixed locking latch 15 (FIG. 1) is engaged in locking slot 19 (FIG. 1), so that universal boot plate 14 is securely locked onto base plate 11.

Upper and lower housings 21 and 22 seal out snow and ice from the movable mechanisms therein, so that slidable locking latch 24 remains operable even when latch assembly 17 is covered in snow and ice. Further, slidable locking latch 24 cannot be retracted by pushing against it, so that boot plate 14 cannot be accidentally released under the forces normally applied thereto, even during extreme snowboarding conditions.

FIGS. 7–8

Figure 7:
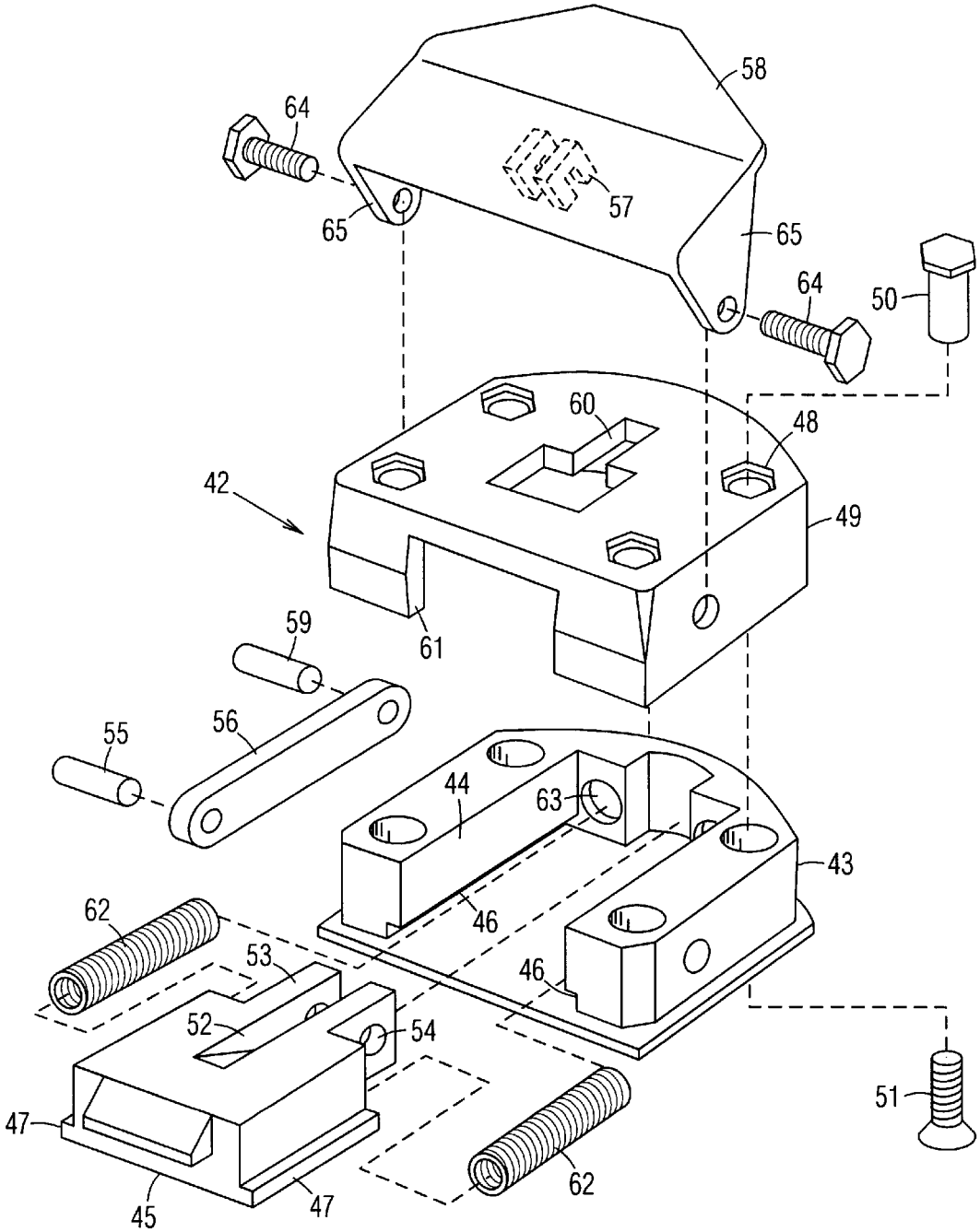
FIG. 7 is an exploded view of an alternative latch assembly.
Figure 8:
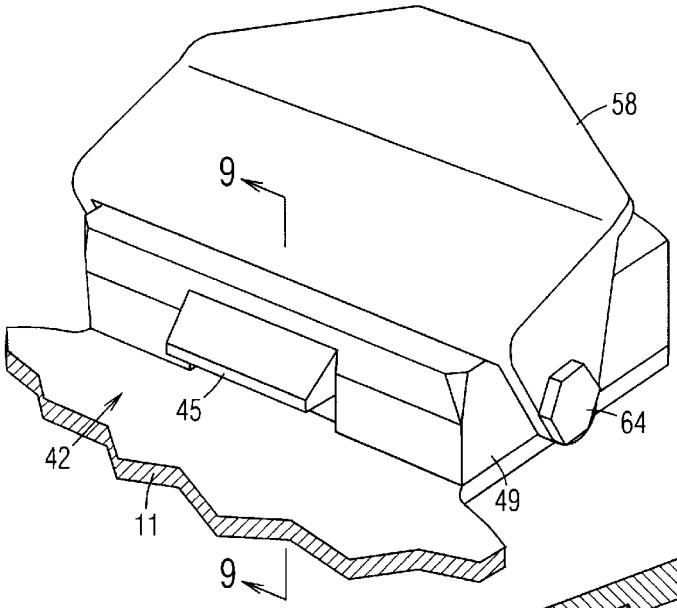
FIG. 8 is a side perspective view of the alternative latch assembly.

An alternative latch assembly 42 is shown in an exploded view in FIG. 7 with mating parts connected by dashed lines. A lower housing 43 includes a longitudinal channel 44 for receiving a slidable locking latch 45. A pair of longitudinal guide slots 46 extend along the sides of channel 44 for slidably receiving a pair of longitudinal guide rails 47 extending along the sides of slidable locking latch 45. Hexagonal holes 48 on an upper housing 49 receive self-clinching standoff fasteners 50 (one shown) that mate with flathead screws 51 (one shown) extending upwardly through base plate 11 (FIG. 1) and lower housing 43. A longitudinal slot 52 extends along slidable locking latch 45 between a pair of ears 53 projecting rearward therefrom for being positioned on either side of a push rod 56. A pair of aligned holes 54 are arranged on ears 53 for receiving a pin 55 extending through a first end of push rod 56. A second end of push rod 56 is for positioning between a pair of U-shaped brackets 57 attached to the bottom of a lever 58. A pin 59 extending through the second end of push rod 56 secures it to brackets 57 by being positioned between the arms of brackets 57. Push rod 56 extends through a slot 60 in upper housing 49. The tapered front end of slidable locking latch 45 is arranged for projecting through an opening 61 on the front of upper housing 49. A pair of compression springs 62 are for being positioned between the rear of slidable locking latch 45 and a pair of recesses 63 on the rear wall of lower housing 43. A pair of bolts or axles 64 pivotally connect a pair of extensions 65 projecting downwardly from lever 58 to opposite sides of upper housing 49 and lower housing 43. Latch assembly 42 is shown assembled and attached to base plate 11 in FIG. 8.

FIGS. 9–10

Figure 9:
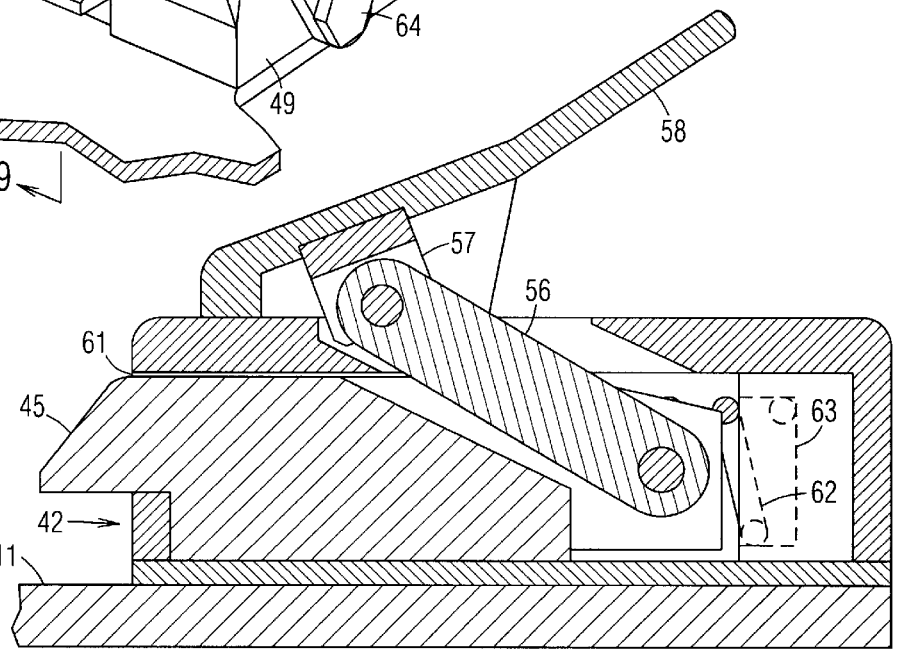
FIG. 9 is a side sectional view of the alternative latch assembly in a locked position.
Figure 10:
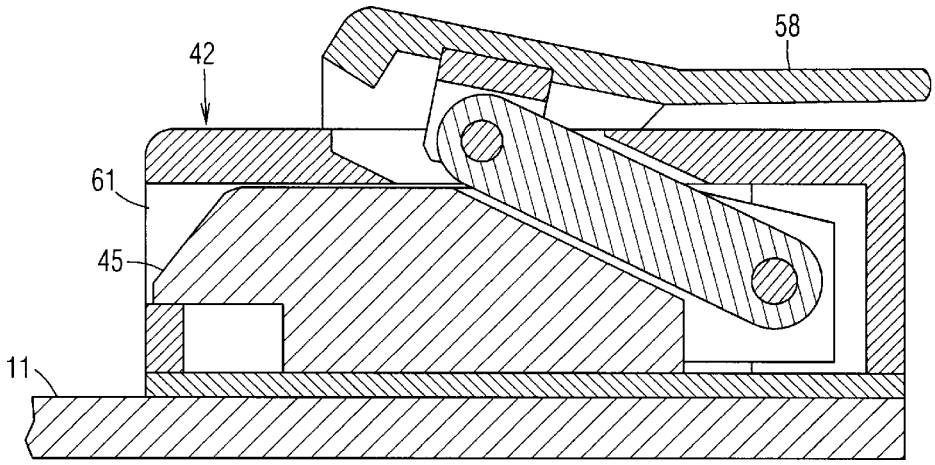
FIG. 10 is a side sectional view of the alternative latch assembly in an unlocked position.

Latch assembly 42 is shown in a sectional view in FIG. 9. Slidable locking latch 45 is biased to its forward or locking position by springs 62 (one shown), so that its front end is projected through opening 61. Lever 58 is linked to slidable locking latch 45 by push rod 56, so that it is pivoted to its uppermost position. Slidable locking latch 45 may be retracted by pushing down lever 58, as shown in FIG. 10. Universal boot plate 14 (FIG. 1) is attached by stepping onto base plate 11 with its inside edge first, so that locking slot 19 (FIG. 1) is engaged by fixed locking latch 15 (FIG. 1). The outside edge of universal boot plate 14 is then pushed down. Slidable locking latch 45 is temporarily retracted when pushed upon by universal boot plate 14, but it is biased forwardly into a locking position in slot 20 (FIG. 1) by spring 62 when universal boot plate 14 is fully seated. Universal boot plate 14 may be released by pressing, down lever 58. The spring loading of slidable locking latch 45 ensures that it cannot be released accidentally.

SUMMARY AND SCOPE

Accordingly, I have provided a snowboard binding that resists accidental release, and resists jamming by snow and ice.

Although the above descriptions are specific, they should not be considered as limitations on the scope of the invention, but only as examples of the embodiments. Many substitutes and variations are possible within the teachings of the invention. For example, latches may extend from the sides of boot plate 14 for mating with a fixed slot on one edge of base plate 11, and an extendible slot on an opposite edge of base plate 11. Thus locking and engaging means other than those shown may be used. Lever 18 may be replaced with a knob. Other universal boot plates may be used. The binding may be used for hard boots. It may also be used on snow skis, or on other devices for fastening a boot or boot plate. Therefore, the scope of the invention should be determined by the appended claims and their legal equivalents, not by the examples given.

I claim:

1. A binding, comprising:

a base plate having a top surface for supporting a boot plate;

a first locking latch attached adjacent a side edge of said base plate for mating with a side of said boot plate;

a slidable locking latch slidably positioned adjacent an opposite side edge of said base plate for mating with another side of said boot plate;

a lever having an inner end hinged about a horizontal axle fixed relative to said base plate, said lever having a outer end; and a push rod having one end hinged to said lever at a position between said horizontal axle and said outer end, said push rod having another end hinged to an inner end of said slidable locking latch, so that said slidable locking latch is in an extended position when said lever is in a raised position for engaging and locking said boot plate, said slidable locking latch is moved linearly to a retracted position when said lever is moved to a lowered position for disengaging from and unlocking said boot plate, whereby said boot plate is released by pressing on said lever.

2. The binding of claim 1, further including a spring biasing said slidable locking latch toward said extended position and said lever toward said raised position.

3. The binding of claim 1, further including a housing attached to said base plate, said housing generally enclosing said slidable locking latch and said push rod for sealing out snow and ice, said housing including an opening through which said slidable locking latch is extendible for engaging said boot plate.

4. The binding of claim 3, wherein said lever is generally as wide as said housing, and further including a pair of ears extending down from opposite side edges of said lever and pivoted on opposite outer sides of said housing, said ears being spaced far enough apart to provide mechanical stability.

* * * * *